United States Patent [19]

Graves, Jr.

[11] Patent Number: 4,702,264

[45] Date of Patent: Oct. 27, 1987

[54] TOBACCO LEAF PROCESSING

[75] Inventor: William H. Graves, Jr., Pfafftown, N.C.

[73] Assignee: R. J. Reynolds Tobacco Company, Winston-Salem, N.C.

[21] Appl. No.: 895,066

[22] Filed: Aug. 11, 1986

[51] Int. Cl.[4] ..... A24B 3/14

[52] U.S. Cl. ..... 131/370; 131/375

[58] Field of Search ..... 131/370–375

[56] References Cited

U.S. PATENT DOCUMENTS 2,433,877 1/1948 Wells et al. .
2,592,554 4/1952 Frankenburg .
2,769,734 11/1956 Bandel .
3,053,259 9/1962 Parmele et al. .
3,076,729 2/1963 Garbo .
3,136,321 6/1964 Davis .
3,209,763 10/1965 Parmele et al. .
4,144,894 3/1979 Schmidt et al. .
4,236,538 12/1980 Foster et al. .
4,421,126 12/1983 Gellatly .
4,646,764 3/1987 Young et al. .

*Primary Examiner*—V. Millin
*Attorney, Agent, or Firm*—Grover M. Myers

[57] ABSTRACT

Whole leaf tobacco can be processed to yield a sheet-like product which can be used to cut filler for the manufacture of cigarettes. Whole leaf tobacco including stem is shredded and contacted with a binding agent in dry form. The essentially dry mixture is shear agitated in the presence of moisture less than about 30 percent, based on the total weight of moisture, binding agent and tobacco. The divided tobacco is subjected to the high shear agitation in the presence of sufficient moisture to provide for activation of the binding agent. The sheared mixture is passed through a roller system to provide compressive treatment to the mixture. The processed mixture is further formed into a sheet-like shape. Tobacco material can be provided using low amounts of binding agent, using energy efficient processing steps, and without waste of tobacco material.

40 Claims, 11 Drawing Figures

TOBACCO LEAF PROCESSING

BACKGROUND OF THE INVENTION

This invention relates to the processing of tobacco leaf, and in particular to the processing of tobacco leaf to provide cut filler for the manufacturing of smoking articles such as cigarettes.

Cured tobacco leaf conventionally undergoes several processing steps prior to the time that the resulting cut filler is provided. For example, tobacco leaves are threshed in order to separate the tobacco laminae from the stem. The tobacco laminae undergo further processing resulting in cut filler, while the stems are discarded or employed in the manufacture of reclaimed tobacco products of relatively low quality.

The handling, threshing and storing stages of conventional tobacco leaf processing steps result in the formation of considerable amounts of wasted tobacco material. In particular, typical processing conditions cause the formation of relatively large amounts of dust and fines. Such dust and fines are of such a small size as to be of essentially no use in the manufacture of cigarettes. However, it is possible to retrieve some of the dust and fines, and employ these materials with tobacco stems in the manufacture of reclaimed tobacco materials.

It would be highly desirable to provide an efficient process for providing processed tobacco material in the form of cut filler whereby all of the tobacco leaf is employed and essentially no waste of the cured tobacco leaf is recognized.

SUMMARY OF THE INVENTION

In one aspect, the present invention is a process for providing processed tobacco material in sheet-like form, the process comprising:

(a) providing tobacco material wherein at least a substantial proportion thereof is provided in essentially whole leaf form; and (b) providing in essentially dry, substantially non-binding form, binding agent which is capable of being activated; and (c) subjecting the aforementioned tobacco material to a size reduction action in order to provide divided tobacco material; and then (d) contacting the divided tobacco material and binding agent; and then (e) subjecting the divided tobacco material and binding agent to high shear agitation (i) in the presence of sufficient moisture to provide for activation of the binding agent but in the presence of a moisture content of less than 30 percent based on the total weight of moisture, binding agent and tobacco material, and (ii) for a period of time sufficient to at least initiate activation of the binding agent; and then (f) subjecting the tobacco material so subjected to high shear agitation to compressive treatment by passing the tobacco material, at least once, through the nip of a roller system; and then (g) forming sheet-like processed tobacco material from the tobacco material which has been passed through the aforementioned roller system.

Preferably, the size reduction action is a cutting action which is most preferably provided by a high shear slicing, shredding or chopping device, such as a Hobard HMC-450 Mixer. The divided material so provided includes individual particles of a size small enough to be processed using the roller system. Most preferably, portions of stems of the divided material have lengths of less than about 1.5 inch.

Preferably, the high shear agitation step which provides for at least the initiation of activation of the binding agent is provided using a device which is similar to or the same as the high shear device used in the previous process step for providing divided material. Alternatively, well divided material can be subjected to high shear agitation using a high shear extrusion device such as a screw extruder.

Preferably, the roller system is a pressurized roller system wherein there is provided a relatively great amount of compressive strength between the roller faces. In such a manner, the tobacco material can be efficiently and effectively worked into a material having a sheet-like shape and consistency. More preferably, the tobacco material/binding agent mixture which has been subjected to high shear agitation is passed, at least once, through the nip of a pressurized roller system having two rollers exhibiting a nip zone pressure sufficient to provide compression of the tobacco material, wherein (i) at least one of the roller faces comprises a series of grooves, the series extending longitudinally along the roller and each groove extending about the periphery of the roller, and (ii) each groove has a maximum width near the surface of the roller and a minimum width near the bottom of the groove. Most preferably, one of the roller faces of the pressurized roller system has the aforementioned series of grooves.

In another aspect, the present invention is a process for providing processed tobacco in sheet-like form, the process comprising:

(a) providing tobacco material wherein at least a substantial proportion thereof is provided in essentially whole leaf form; and (b) providing in essentially dry, substantially non-binbind form, binding agent which is capable of being activated; and (c) contacting the tobacco material and binding agent; and then (d) subjecting the tobacco material and binding agent to high shear agitation (i) including a cutting action in an amount sufficient to provide divided tobacco material, (ii) in the presence of sufficient moisture to provide for activation of the binding agent but in the presence of a moisture content of less than 30 percent based on the total weight of the moisture, binding agent and tobacco material, and (iii) for a period of time sufficient to at least initiate activation of the binding agent; and then (e) subjecting the tobacco material so subjected to high shear agitation to compressive treatment by passing the tobacco material, at least once, through the nip of a roller system; and then (f) forming sheet-like processed tobacco material from the tobacco material which has been passed through the aforementioned roller system.

This invention allows for the processing of tobacco leaf in an efficient and effective manner in a relatively short period of time using a low energy intensive process which requires neither relatively large amounts of moisture nor relatively large amounts of binding agent. In addition, this invention provides for the preparation of a sheet-like product which readily can be cut to the desired size as cut filler with essentially no waste of tobacco material. Depending upon factors such as the binding agent used, the process of this invention can be performed at or near ambient temperatures without the necessity of the application of external heat. If desired, this invention can be performed without chemical pretreatment of the tobacco.

The processed tobacco material can be employed as is known in the art. For example, the tobacco material provided by the process of this invention can be dried or moistened, treated with additives, blended with other tobacco products, cut to the desired size, etc. The resulting tobacco material is most useful in the manufacture of cigarettes.

DETAILED DESCRIPTION OF THE EMBODIMENTS

Figure 1:
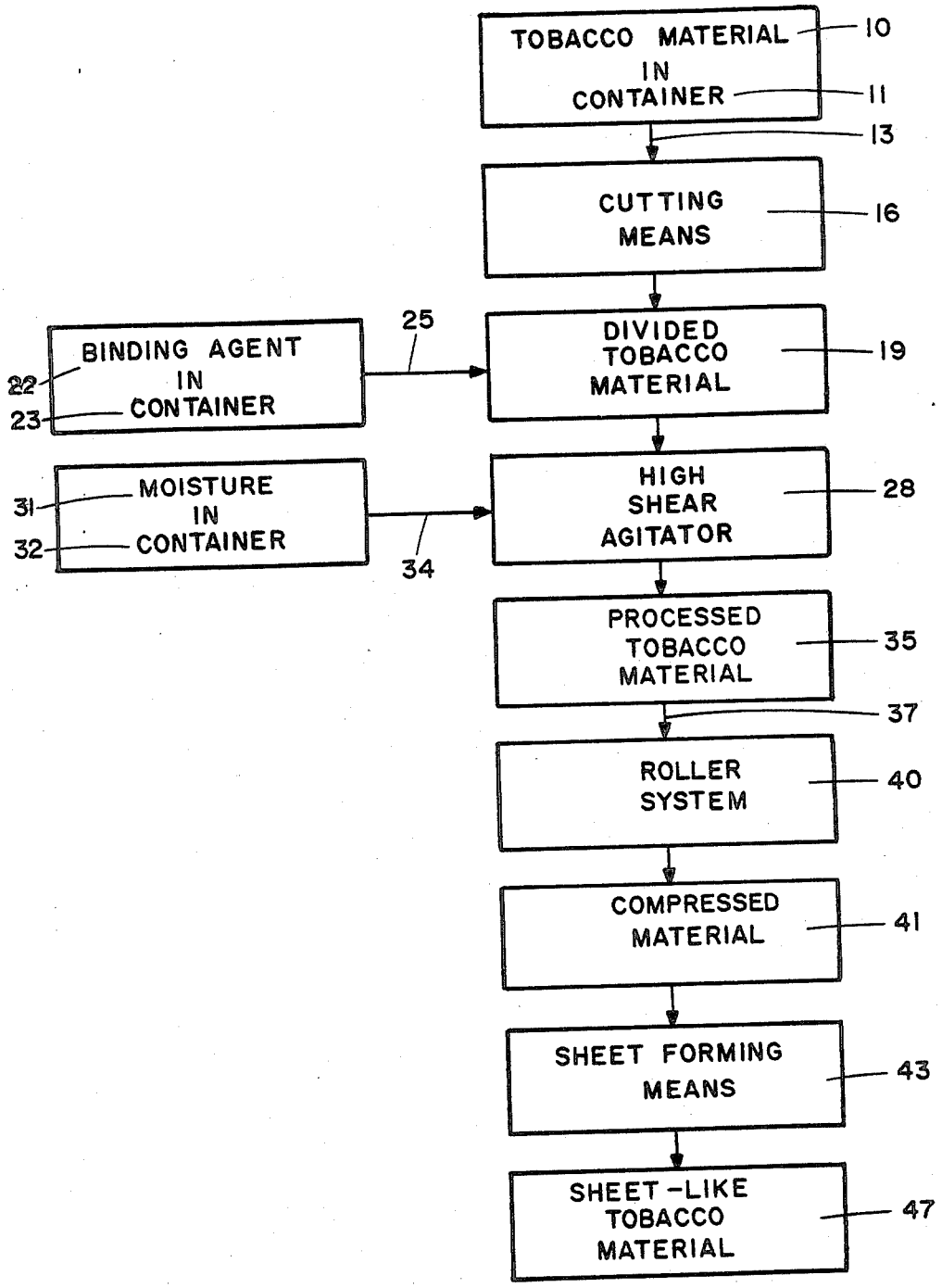
FIG. 1 is a schematic diagram of one preferred embodiment of the processing steps of this invention.

Referring to FIG. 1, tobacco material 10 is contained in a container 11 such as a storage bin, crate, vessel, hopper, or the like. Tobacco material 10 is transferred from the container 11 by conveying means 13 to cutting means 16 such as a high shear agitation means. The conveying means 13 can be a conveyer belt, a transfer line, simple pouring or dumping device, a volumetric feeder, or the like. The tobacco material 10 is subjected to high shear agitation using cutting means 16 in order to provide divided (e.g., shredded or chopped) tobacco material 19. Binding agent 22 is contained in a container 23 and is transferred from the container by a conveying means 25 so as to be in contact with the divided tobacco material 19. The shredded or chopped tobacco material and binding agent 22 are subjected to high shear agitation using a high shear agitation means 28. The high shear agitation means 28 can be the same device as employed in providing the previously described cutting action, a high shear screw extruder, or the like. The shredded or chopped tobacco material and binding agent are subjected to shear agitation in the presence of moisture 31 which is contained in container 32 and is transferred therefrom to the tobacco material by conveying means 34 such as a sprayer, a transfer line, simple pouring or dumping device, or the like. The resulting processed tobacco material 35 is transferred from the high shear agitation means 28 by transfer means 37 to roller system 40 and is passed through the roller system to provide compression of the material. The resulting compressed material 41 is passed through a sheet-forming means 43 resulting in sheet-like material 47. Preferably, the sheet-forming means is a roller system.

The tobacco material useful in this invention can vary. Typically, a portion of the tobacco material can include tobacco dust, tobacco fines, tobacco laminae, scrap tobacco which is recovered from various processing stages and cigarette manufacture stages, scraps and/or sheets of wet formed reconstituted tobacco (for example in dry form), scraps and/or sheets of dry formed reconstituted tobacco, tobacco leaf steams, rolled tobacco stems, and tobacco stems and stalks. The sizes of the various pieces or particles of tobacco material employed are not particularly critical.

At least a substantial proportion of the tobacco material is employed is provided in essentially whole leaf form. By the term "essentially whole leaf form" is meant the entire leaf including the stem. Tobacco material in essentially whole leaf form includes cured tobacco provided from prize houses; and aged tobacco provided from bales, hogsheads and boxes. In particular, the total tobacco leaf including stem can be employed without throwing away any portion thereof. It is possible that portions of the tobacco leaf can be broken into pieces, however, such a breakage need not be done purposefully as is common in conventional tobacco leaf processing. Preferably, tobacco material in essentially whole leaf form includes tobacco which is not threshed or de-stemmed. However, it may be desirable to clean or de-sand tobacco leaf using a screening technique or the like, prior to the processing steps of this invention. Examples of suitable types of tobacco leaf include burley, flue-cured, Maryland and oriental tobaccos. Types of tobacco can be processed separately or as blends thereof.

By the term "substantial proportion" in referring to tobacco material is meant greater than about 50 weight percent of the tobacco material which is processed according to the process of this invention. However, if desired, essentially all of tobacco material which is processed can be in essentially whole leaf form.

By the term "divided tobacco material" is meant tobacco material in essentially whole leaf form which has been subjected to size reduction action using equipment capable of forming smaller sized particles or pieces of tobacco material from the tobacco material in essentially whole leaf form. Preferably, size reduction action includes a cutting action including chopping, tearing, slicing or shredding. Preferably, divided tobacco material exhibits a size capable of being processed further using the roller systems used in this invention. Typically, the laminae portion of the leaf can be cut or shredded to a size ranging from a small size approximating that of tobacco dust to relatively large pieces of leaf having lengths and widths of up to about 2 inchs, respectively. Typically, portions of stems are milled, cut or shredded to sizes smaller than about 1.5 inch in length, preferably to a size wherein the majority of stem material exhibits a length in the range from about 0.25 inch to about 1 inch. Examples of high shear agitation means for providing shredded tobacco material include high speed rotating blades such as are provided by a commercially available Hobard HMC-450 Mixer. Shredding using the aforementioned mixer typically occurs over a time period ranging from about 3 minutes to about 15 mintues. Generally, shearing action for longer periods of time provides smaller sized shredded tobacco material. Generally, shredding occurs at ambient temperatures. Chopped or shredded material can be of a small size but generally the individual pieces of chopped material are larger than the powdered material provided by grinding processes such as those processes incorporating ball mills. Preferably, the tobacco material is shredded essentially dry at moisture content of about 6 to about 12 percent.

A binding agent (i.e., binder) is employed in the process of this invention and is most preferably a binding agent which is capable of being water or moisture initiated or activated. Examples of suitable binding agents include starches, modified starches, carboxymethylcellulose, sodium carboxymethylcellulose, hydroxypropylcellulose, carboxyhydroxy methylcellulose, guar gum, carragrenan gum, xantham gum, locust bean gum, hydroxylethyl amylose, tobacco extracts, pectins, sodium alginate, a binder sold commercially as Bermocoll E270G by Berol Kemlab, and the like, as well as combinations thereof such as a blend of carboxymethylcellulose and guar gum, a blend of xanthan gum with locust bean gum, or a blend of locust bean gum with guar gum.

The amount of binding agent which is employed relative to the tobacco material can vary depending upon factors such as the type of binding agents, the moisture content of the tobacco material, the temperature at which the tobacco material and binding agent are subjected to the high rates of shear agitation, and other such factors. Typically relatively low amounts of binder are employed. It is preferable to employ less than about 15 weight percent, more preferably less than about 10 weight percent, most preferably less than about 2 percent binding agent, based on the total weight of binding agent, moisture and tobacco material dry weight.

The shredded tobacco material and binding agent are contacted and subjected to a high rate of shear agitation. The manner in which the tobacco material and binding agent are contacted can vary and is not particularly critical. For example, the tobacco material and binding agent each can be added bulk-wise to the apparatus which provides the high rate of shear agitation. Preferably the binding agent is employed in a substantially dry form when contacted with the substantially dry, divided tobacco material. The binding agent is dispersed (e.g., mixed) with the tobacco material, and any moisture which may be necessary is then added to the tobacco material either prior to or during high shear agitation of the tobacco material.

As used herein the term "high rate of shear agitation" is meant to include that agitation which is sufficiently high in order to provide at least initiation of activation of the binding agent which is contacted with the tobacco material (i) during a relatively short period of time, (ii) without the necessity of applying external heat in order to subject the tobacco material and binding agent to temperatures significantly greater than ambient temperature, and (iii) without the necessity of subjecting the tobacco material and binding agent to moisure greater than about 30 weight percent, based on the total weight of tobacco material and moisture. Typical high agitation rates exceed about 1,000 rpm, and preferably exceed about 3000 rpm as determined for a commercially available Hobard HMC-450 Mixer. The high rates of agitation can provide very rapid movement of the shearing means such as knives, blades, paddles, propellers, and the like. The time period over which the tobacco material and binding agent are subjected to the high rate of shear agitation can vary and can be as long as desired, but typically is less than about 10 minutes, more preferably between about 3 minutes and about 6 minutes. Typically the tobacco material and binding agent are subjected to the high rate of shear agitation under conditions such that the surrounding temperature is in the range from about 65° F. to about 110° F., although other temperature ranges can be employed. It is believed that the high rate of shear agitation provides good dispersion of the binding agent relative to the tobacco material, and that the shear agitation provides shear energy which may provide at least the initiation of activation of the binding agent.

As used herein the term "activation" in referring to the binding agent is meant to include the introduction of the latent adhesive properties to the binding agent. Such introduction of adhesive properties can be provided by application of heat, moisture, pressure, shear energy, or the like. In particular, the binding agent loses its substantially dry character and behaves substantially as an adhesive which is capable of adhering the divided tobacco material together. The tobacco material and binding agent mixture which has been subected to high shear agitation according to this invention generally exhibits a formable, somewhat consistent character and can be somewhat tacky in nature.

As used herein the term "initiation" means the introduction of activation properties to the binding agent.

High rates of shear agitation sufficient to initiate activation of the binding agent can be provided using an apparatus such as a high intensity mixer, a homogenizer, a blender, a high shear extruder, or other high shear device. For example, from about 50 g to about 300 g of divided tobacco material, binding agent and moisture can be subjected to high shear mixing using a commercially available Waring Blender set at medium speed for about 5 minutes or high speed for about 3 minutes, while periodically scraping the sides of the mixing container with a device such as spatula in order to minimize cavitation of tobacco material and promote adequate thorough mixing. As another example, from about 1 kg to about 10 kg of tobacco material, binding agent and moisture can be subjected to high shear mixing using a commercially available Hobard HMC-450 Mixer having the timer set for about 5 minutes. As another example, a high shear extruder providing the necessary shearing such as can a commercially available single or double screw extruder can be employed.

The moisture content of the tobacco material and binding agent can vary. Typically, a low moisture content mixture requires a relatively greater amount of force in order to ultimately provide processed tobacco materials; while a high moisture content requires the undesirable and energy intensive drying processes attendant in conventional water based reconstituted tobacco processes. Typically, the tobacco material and binding agent mixture which is employed in the process of this invention exhibits a moisture content of at least about 12 weight percent, preferably at least about 15 weight percent; while the upper limit of the moisture content is less than about 30 weight percent, and typically is less than about 25 weight percent, preferably is about 18 weight percent, based on the dry weight of the tobacco material, binding agent and total moisture. Typically, higher amounts of moisture permit the use of lower amounts of binding agent. Most preferably, the moisture content of tobacco material is not increased above about 18 weight percent prior to the time that the filler material and binding agent are contacted and blending (i.e., mixing) thereof is commenced. It is believed that moisture imparts a softening of tobacco material as well as providing a material having a pliability sufficiently low to allow for the utilization of a desirable force during the subsequent sheet forming process. It is desirable that the moisture content not be overly high as to require excessive drying of the resulting tobacco containing sheet-like material, or as to cause an undesirable pliability of tobacco material and provide a sheet of relatively poor tensile strength.

The process of this invention provides an efficient and effective means for incorporating water and/or temperature sensitive flavorants into the processed sheet. For example, certain flavorants such as tobacco extracts, vanillin, chocolate, licorice, and the like can be blended with the tobacco material, binding agent and/or moisture. As the process of this invention can be performed at near ambient temperatures the desirable characteristics of the flavorants are not lost due to degradation or chemical transformation caused by high temperatures. In addition, as the process of this invention is performed using relatively low moisture levels and relatively low amounts of liquid water are removed from the processed tobacco material, only relatively small amounts of moisture sensitive and/or water soluble flavorants are lost during processing stages.

Figure 2:
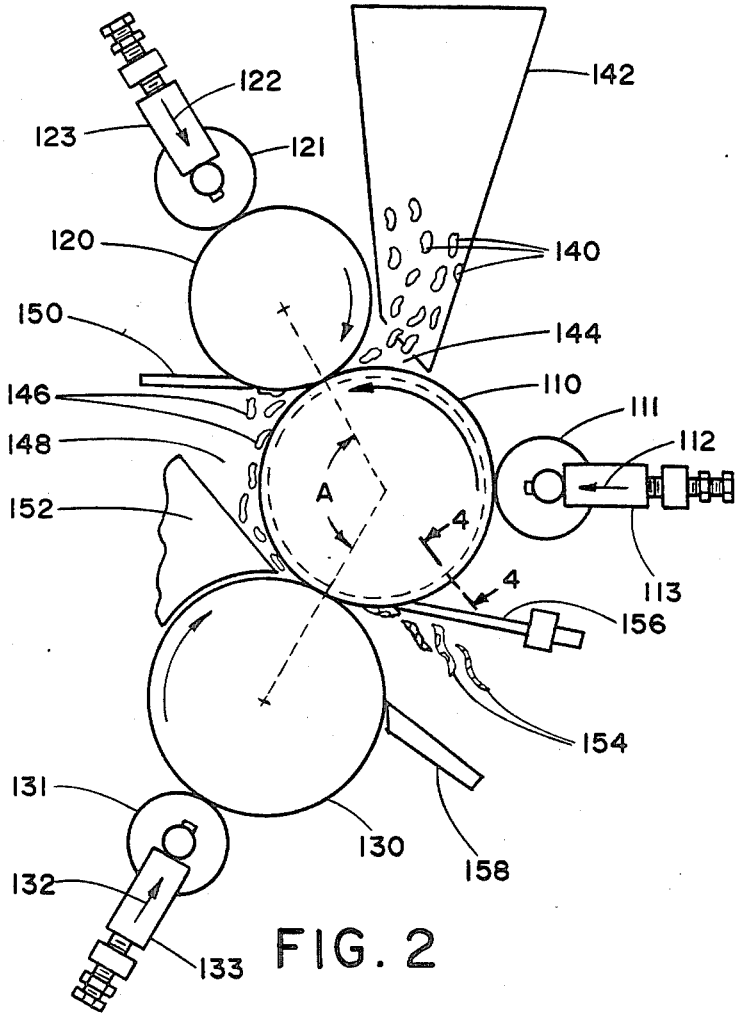
FIG. 2 is a diagrammatic illustration of an apparatus useful in a portion of the process of this invention showing the two pressurized roller systems and material processed therewith.
Figure 3:
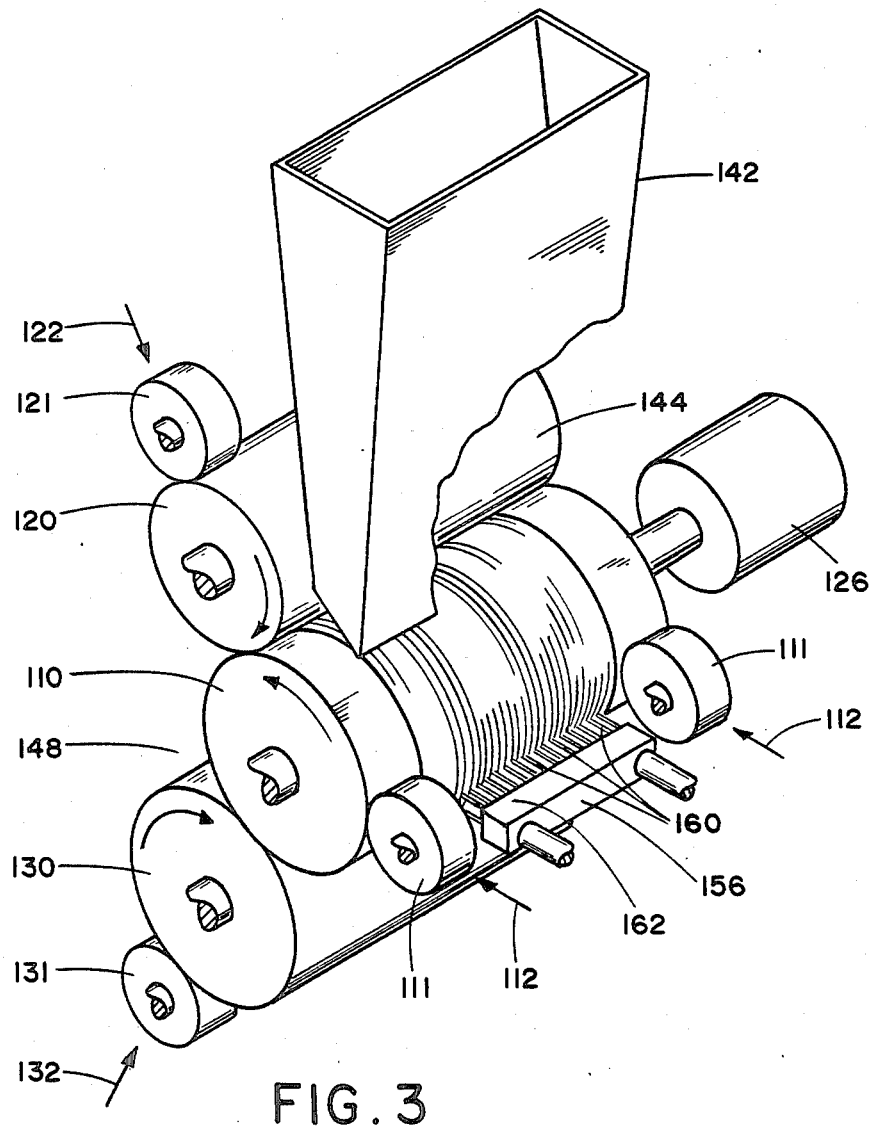
FIG. 3 is a perspective of an apparatus useful in a portion of the process of this invention showing the preferred pressurized roller systems, the feed hopper (shown as partially cut away), and the means for removing processed tobacco material from the roller face of a roller of the second pressurized roller system.

FIGS. 2 and 3 illustrate an apparatus for conducting a portion of the process of this invention. The apparatus which is illustrated is particularly useful for providing a compressed and formed material from divided tobacco material, binding agent and optional flavorant which have been subjected to high shear agitation using the high shear mixing device. The apparatus comprises a first pressurized roller system and a second pressurized roller system. As used herein, the term "pressurized roller system" means two rollers in roll contact and exhibiting a nip zone pressure sufficient to provide compression of tobacco material which passes therethrough into a more compressed form. The apparatus includes roller 110 which is a common roller to each of the first and second pressurized roller systems. The first pressurized roller system includes substantially cylindrical roller 110 and another substantially cylindrical roller 120 in roll contact with one another. By the term "roll contact" is meant that two rollers aligned with roll faces essentially parallel to each other have the roll faces thereof in contact with one another for a distance along the length of each roller, and whereby each roller is capable of being rotated about the longitudinal axis of each roller. Each of the rollers forming the first pressurized roller system are mounted such that the aforementioned roll contact of roller 110 with roller 120 is substantially maintained during the process of the invention. Force is applied to each of roller 110 and roller 120 by compression rollers 111 and 121, respectively in roll contact with each of rollers 110 and 120. The force is provided in a direction shown schematically by arrow 112 and arrow 122, respectively. The force can be provided to rollers 111 and 121 by jack screws 113 and 123, respectively. Alternative force providing means can include hydraulic cylinders, hydraulic pumps, or the like. Alternatively, the force providing means can be compression springs, tension springs, or the like. Preferably, two compression rollers are positioned on each roller of the pressurized roller system and are positioned towards the end of the roller with which the compression rollers are in roll contact (as shown in FIG. 3). Typically, each of the two such compression rollers have diameters and a combined longitudinal length less than that of the roller with which the compression rollers are in roll contact. The jack screw is positioned on each compression roller. Each of rollers 110 and 120 are rotated in the direction indicated by the arrows within the rollers. The rollers are rotated in opposite directions relative to one another in order that the tobacco material can be passed through the nip of the rollers. Each of the rollers can be driven using a power source 126 (shown in FIG. 3) such as a variable speed motor (e.g. an electric motor having from about 1 to about 5 horsepower) which turns the rollers by a series of drive gears (not shown). The rollers are supported by support means such as a frame (not shown) to a chassis (not shown).

The second pressurized roller system includes roller 110 and another substantially cylindrical roller 130 in roll contact with one another. Each of the rollers forming the second pressurized roller system are mounted such that the aforementioned roll contact of roller 110 with roller 130 is substantially maintained during the process of this invention. Force is applied to each of roller 110 and 130 by compression rollers 111 and 131 in roll contact with each of rollers 110 and 130, respectively. The force is provided in a direction shown schematically by arrow 112 and arrow 132, respectively. The force can be provided to rollers 111 and 131 by jack screws 113 and 133, respectively. Compression roller 131 and force providing means 133 are positioned as are the compression rollers and force providing means described hereinbefore. Each of rollers 110 and 130 are rotated in the direction indicated by the arrows within the rollers. The rollers are rotated in opposite directions relative to one another in order that the tobacco material can be passed through the nip of the rollers. Each of the rollers can be driven using a power source 126 (shown in FIG. 3) which turns the rollers by a series of drive gears (not shown). The rollers are supported by support means such as a frame (not shown) to a chassis (not shown).

Rollers positioned relative to one another in the configuration shown in FIG. 2 form angle A which can be defined as that angle formed by the roll axis (i.e., the longitudinally extending axis) of each of rollers 120, 110 and 130, respectively. The value of angle A can depend upon a variety of factors including the diameters of the various rollers. Typically, angle A ranges from less than 180° to a limiting angle defined by the diameter of the rollers, and preferably ranges from about 90° to about 150°.

In an embodiment shown in FIGS. 2 and 3, rollers 120 and 130 each have a substantially smooth (i.e., non-grooved) roller face; and roller 110 (which is in roll contact with both of rollers 120 and 130) contains the series of grooves therein. The series extends longitudinally along the roller wherein each groove extends about the periphery of the roller.

When compression rollers are employed at each end of the roller system rollers in order to provide the required nip zone pressures to the roller systems, it is most preferable that the grooved rollers have grooves positioned along the longitudinal length of the roller only in the region between the compression rollers (i.e., the roll ends are not grooved).

The forces between the rollers which typically are required in the process of this invention can vary, but are those forces which are great enough to generate sufficient roller nip zone pressures in order to provide or form ultimately well mixed, compressed tobacco materials. That is, sufficient nip zone pressures are those sufficient to provide shearing, mixing, and forming of said tobacco material, and can be as great as is desired. Typically, forces between rollers of at least about 1,000, and as great as about 10,000, preferably about 4,000 to about 6,000 pounds per linear inch, are great enough to generate sufficient roller nip zone pressures. Typically, the rollers are constructed of a metal material such as hardened carbon steel or hardened alloy steel, or other material sufficient to withstand the compression.

The sizes of the various rollers can vary. Typically, roller diameters range from about 3 inches to about 12 inches, preferably about 6 inches to about 8 inches; while roller lengths range from about 4 inches to about 24 inches. Rollers forming the two roller systems can each have diameters which are equal, or the diameters of the various rollers can differ. Rotational roller speeds range, for example, from about 4 rpm to about 30 rpm.

Operation of the apparatus of FIGS. 2 and 3 involves feeding the activated binding agent and tobacco material mixture 140 (i.e., which has been subjected to high rates of shear agitation under conditions sufficient to provide initiation or activation of the binding agent) by hopper 142 to feed zone 144 which in turn feeds the mixture to the nip of rollers 110 and 120. The mixed and pre-formed material 146 which passes through the first pressurized roller system and then is fed into zone 148 which feeds the material to the second roller system. The tobacco material exiting the first roller system can have a tendency to stick to the rollers, and the material can be removed from the rollers (particularly roller 120 as shown in FIG. 2) by scrape 150. Scrape 150 can be a series of needles, comb-like configuration, a corrugated metal sheet, metal finger-like materials, or a knife-like means such as a doctor blade positioned against the length of the face of the roller so as to remove (i.e., scrape) the tobacco material from the face of the roller. Most preferably, scrape 150 is positioned non-tangentially to the surface of the roller. For example, scrape 150 is positioned against the face of roller 120 circumferentially at a location on the surface of the roller within an arc of about 10° to about 45° relative to the point at which rollers 110 and 120 meet in roll contact. Preferably, the scrape is positioned substantially parallel (i.e., within an angle of about 15°) relative to the tangent of the rollers formed by the point of the roll contact of rollers 110 and 120. Scrape 150 is attached to the chassis or frame of the appratus (not shown) in order to maintain the positioning thereof against the face of the roller. If desired, zone 148 can be employed as an auxiliary feed zone where tobacco material, particularly small particle size material such as tobacco dust and/or tobacco fines, can be added to the mixed and pre-formed filler material 146 exiting the first roller system into zone 148. In particular, the compressed, admixed tobacco material 146 can be contacted with tobacco dust and/or tobacco fines in zone 148. Zone 148 can include slide 152 which is a hopper, feed or other such means for directing tobacco material 146 in the second pressurized roller system. The tobacco material 146 in zone 148 which has been mixed and pre-formed under pressure in the first pressurized roller system is generally a macerated and compressed tobacco material having some characteristics of sheet-like tobacco material.

Tobacco material 146 is further formed under pressure into processed material by passing tobacco material 146 through a subsequent second pressurized roller system (i.e., through the nip of rollers 110 and 130). Tobacco material 154 exits the second roller and can be removed from the surface of roller using scrape 156. Scrape 156 is attached to the chassis or frame of the apparatus (not shown) in order to maintain the positioning thereof against the face of roller 110.

Compressed tobacco material in a generally sheet-like form can be provided through the assistance of scrape 156 having the form of a doctor blade or other such means positioned against the face of the roller 110 and extending along the face of the roller. Scrape 156 is positioned along that portion of the length of the roller wherein tobacco material tends to stick to the roller. Scrape 156 is most preferably positioned non-tangentially to the roller. For example, as shown in FIG. 2, scrape 156 is positioned against the face of roller 110 at a circumferential location on the surface of the roller within the arc of about 10° to about 30° relative to the point at which rollers 110 and 130 meet in roll contact and thereby are positioned in a spaced apart relationship. Preferably, the scrape is positioned substantially parallel (i.e., within an angle of about 15°) relative to the tangent of the rollers formed by the roll contact of rollers 110 and 130. Scrape 157 (shown in FIG. 2) provides a means for removing tobacco material from the surface of smooth roller 130. Scrape 157 is a doctor blade or other such means positioned against the face of the roller. Scrape 157 is positioned against the face of roller 130 in much the same manner as scrape 156 is positioned against roller 110. Tobacco material 154 can be directed from the apparatus by collection bin 158 or other removal means, and then collected.

Figure 4:
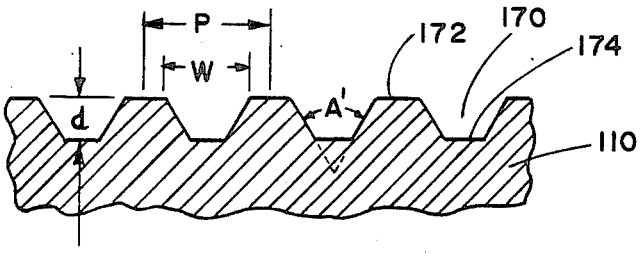
FIG. 4 is an enlarged, partial sectional view of a roller taken along line 4—4 in FIG. 2 and showing a series of grooves, each groove extending circumferentially about the periphery of the roller.

FIG. 4 illustrates a series of grooves 170 positioned along roller 110, and each groove has a top portion 172 (i.e., towards the surface of the roller face) and a bottom portion 174 (i.e., toward the inner portion of the roller). Such a roller is referred to herein as a "grooved roller." Such a grooved roller can provide a shredding, tearing, forming, mixing or blending action to the material which is passed through the roller system. In addition, the working of the material by the action of the grooved roller can act to further activate binding agent within the mixture. The series of grooves extends longitudinally along roller 110 or a portion thereof. The grooves 170 can be incorporated into coller 110 of the first pressurized roller system by techniques such as machining using a suitable lathe. Each groove completely circumscribes roller 110. Preferably each groove has a shape substantially similar to the other grooves which extend along the roller. The grooves can extend about the roller in a radial fashion, a helical fashion, or the like. Preferably, the grooves each circumscribe the rollers substantially transversely relative to the longitudinal axis of the roller. Top portion 172 is flattened and typically ranges in width from about 0.010 inch to about 0.015 inch. Generally, the flattened top portion 72 is narrow enough so as to not require excessive force in order to maintain roller contact in the pressurized roller system; while flattened top portion 172 is wide enough as to not deform to a substantial extent under typical nip zone pressures. Bottom portion 174 can be rounded or flattened (as illustrated in FIG. 4). When flattened, bottom portion 174 typically ranges in width from about 0.003 inch to about 0.007 inch. Generally, bottom portion 174 is narrow enough so as to provide sufficient mixing action of the tobacco material. The mixing action is believed to be provided by the compression feeding performed by the relatively large size leaf stems which carry the tobacco particles into the grooves. Fattened bottom portion 174 is wide enough so as to permit the release of tobacco material from the surface region of the roller after processing. In particular, a bottom portion 174 which is overly narrow or pointed can tend to trap tobacco material in the groove and prevent release of the tobacco material therefrom. The depth d of the groove can vary and typically ranges from about 0.008 inch to about 0.025 inch. The depth is defined as the radial distance between the bottom portion of the groove and the top portion of the groove. The greatest width w of the groove can vary and typically ranges from about 0.015 inch to about 0.040 inch. The width is defined as the lateral distance measured across the groove. The pitch p of the groove can vary and depends upon a variety of factors including the type of tobacco material which is processed, the moisture content of the tobacco material, the shape of the groove, and the like. The pitch is defined as that lateral distance from the center of top portion 172 to the center of the nearest adjacent top portion 172. Typically, a pitch of about 0.02 inch (i.e., about 1/50 inch) to about 0.06 inch (i.e., about 1/16 inch); preferably about 0.03 inch (i.e., about 1/32 inch) is useful for most applications. The shape of groove 170 can vary and depends upon a variety of factors. However, each groove has a maximum width near the surface of the roller and a minimum width near the bottom of the groove. Each groove has sloped sides (i.e., non perpendicular to the roller face) and preferably each groove is generally "V" shaped. For example, pressurized roller system having a roller comprising a series of grooves each having a sloping inner edge each groove circumscribing an angle A' of less than about 120°, can mix tobacco material suitably well; and a pressurized roller system having a roller comprising a series of grooves each having a sloping inner edge, each groove circumscribing an angle A' of greater than about 60°, can release processed tobacco material suitably well. The preferred angle A' ranges from about 60° to about 120°, and is most preferably about 90°.

Figure 5:
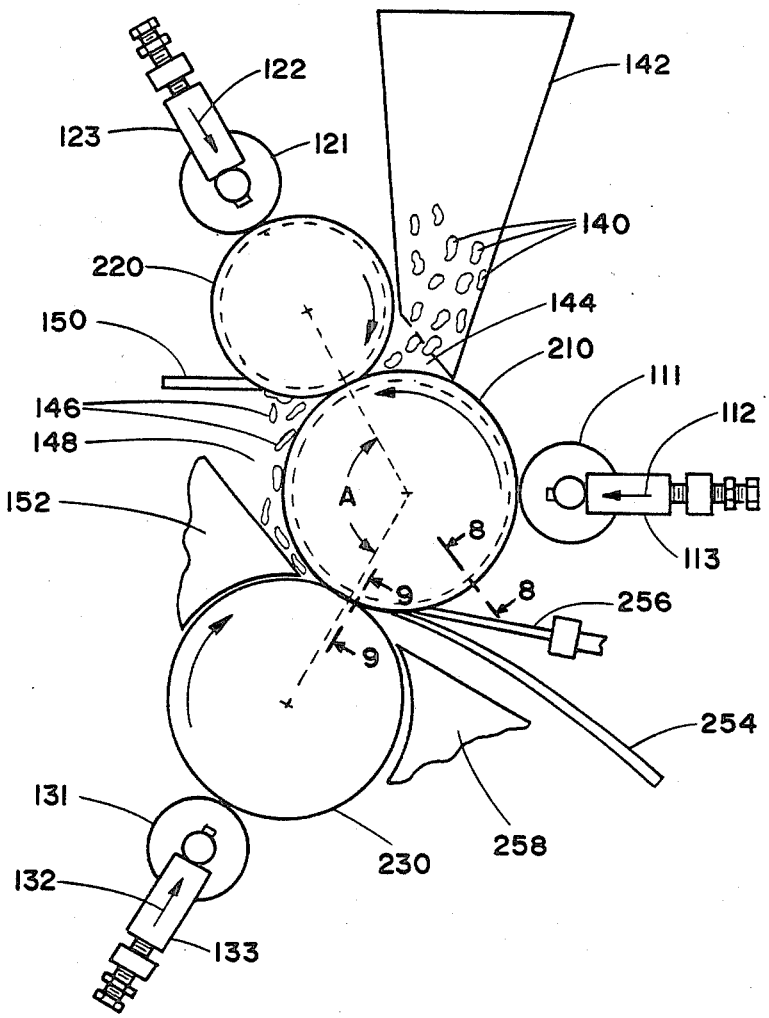
FIG. 5 is a diagrammatic illustration of an apparatus useful in a portion of the process of this invention showing the two pressurized roller systems and material processed therewith.
Figure 6:
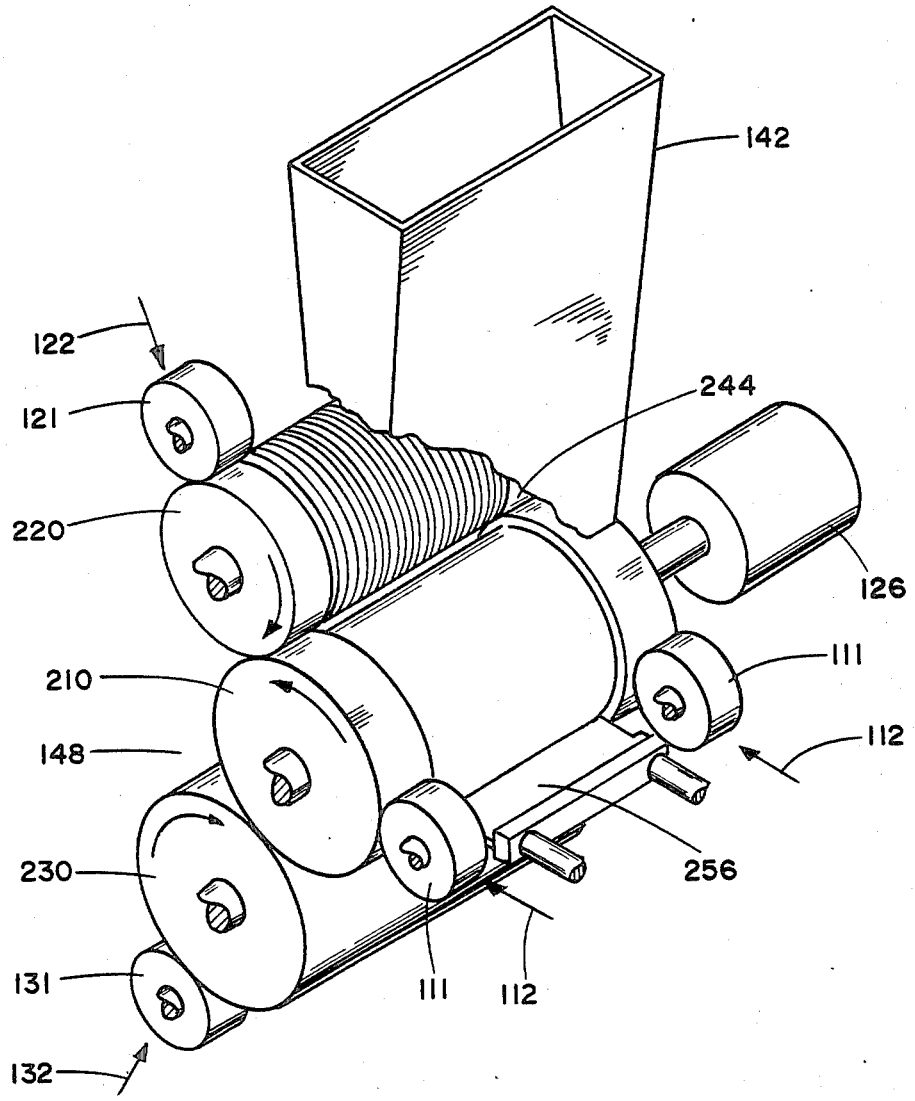
FIG. 6 is a perspective of an apparatus useful in a portion of the process of this invention showing the preferred pressurized roller systems, the feed hopper (shown as partially cut away), and the means for removing processed tobacco material from the roller face of a roller of the second pressurized roller system.

FIGS. 5 and 6 illustrate an apparatus for conducting a portion of the process of this invention. The illustrated apparatus is particularly useful for providing a compressed and formed material from tobacco material, binding agent and optional flavorant which have been subjected to high shear agitation using a high shear mixing device. The illustrated apparatus also is useful for providing the sheet-like processed tobacco material product. The apparatus comprises a first pressurized system and a second pressurized roller system. The apparatus includes roller 210 which is a common roller to each of the first and second pressurized roller systems. The first roller system includes roller 210 and roller 220 in roll contact with one another. The second roller system includes roller 210 and 230 in roll contact with one another. The rollers have sizes, are positioned, are mounted, and are operated as previously described for the apparatus shown in FIGS. 2 and 3. Forces between the various rollers are similar the jack screws, or other such means described previously. Scrapes are positioned against the rollers in order to remove material from the surface of the rollers. Scrape 256 such as a doctor blade or the like is positioned against the face of roller 210 in order to remove processed tobacco material which tends to stick to the surface of the roller.

In the embodiment shown in FIGS. 5 and 6, roller 230 has a substantially smooth (i.e., non-grooved) roller face; and roller 220 contains a series of grooves therein. The series extends longitudinally along the roller wherein each groove extends about the periphery of the roller. Roller 220 has a similar construction to the previously described grooved roller. Roller 210 (which is in roll contact with each of rollers 220 and 230) comprises either a groove extending along the longitudinal axis of the roller and around the periphery of the roller in the region where the sheet-like material ultimately is provided, or a means such as spacer bearings positioned at the ends of the roller in order to provide the desired spaced apart relationship of the rollers. The spaced apart relationship of the surface region of the grooved roller and roller in roller contact therewith allows for easy feeding of tobacco material containing portions of stems.

Figure 7:
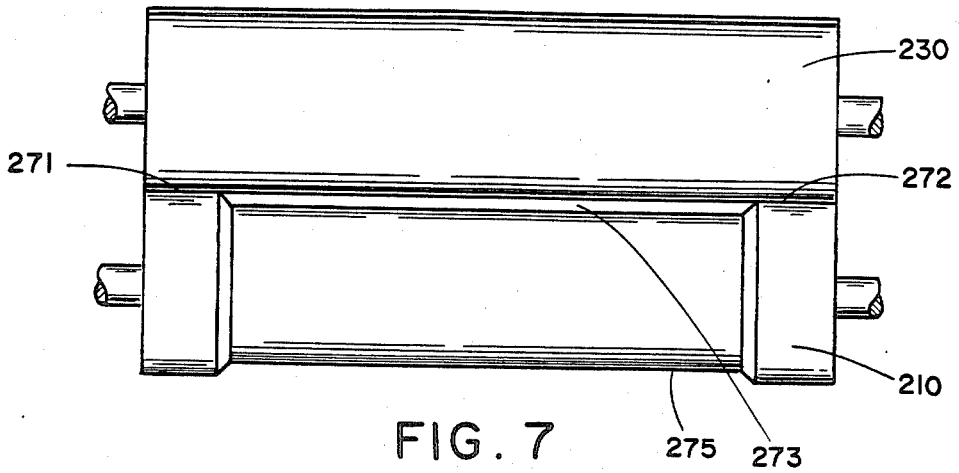
FIG. 7 is an enlarged diagrammatic illustration taken transversely to the longitudinal axis of the rollers showing the longitudinal lengths of two rollers forming one pressurized roller system for the apparatus shown in FIGS. 5 and 6.

FIG. 7 illustrates two rollers of the second pressurized roller system (designated as rollers 210 and 230, respectively) in roll contact with one another towards end region 271 and other end region 272 of each roller. Roller 230 has a substantially smooth surface. The roller faces of each roller are positioned in a spaced apart relationship in region 273 which extends along a portion of the longitudinal length of the rollers. The spaced apart relationship and the corresponding region 273 is provided by groove 275 which extends longitudinally along a portion of roller 210. Typically, the groove extends up to about 90 percent of the longitudinal length of each roller. The groove completely circumscribes the roller in the region which the groove extends longitudinally along the roller. The distance which roller 210 and roller 230 are positioned in a spaced apart relationship can vary and is generally a distance which is capable of providing the sheet-like material of an acceptable thickness. Generally, the distance which roller 210 and roller 230 are positioned in a spaced apart relationship (i.e., the radial distance between the roller face of roller 210 and the roller face of roller 230 as measured in region 273) ranging from about 0.003 inch to about 0.02 inch, with about 0.006 inch preferred.

Figure 8:
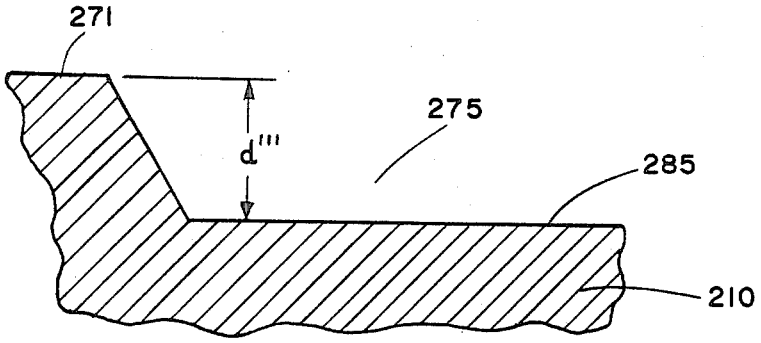
FIG. 8 is an enlarged partial sectional view of one embodiment of a roller taken along line 8—8 in FIG. 5 and showing the depressed groove extending longitudinally along the roller.

In FIG. 8, roller 210 has groove 275 extending longitudinally therealong. Groove 275 has a substantially smooth surface 285. The depressed depth d'' of groove 275 is that radial distance measured from the outermost surface of the roller face at region 271 to surface 285 of the groove. Typically, the depressed depth of the groove is that depth which provides a sheet-like tobacco containing material. Factors such as the tobacco material composition, moisture content of the composition, the amount of binder, forces between rollers, etc., will dictate the depressed depth of the groove. Typically, the depressed depth d" ranges from about 0.004 inch to about 0.012 inch.

Figure 9:
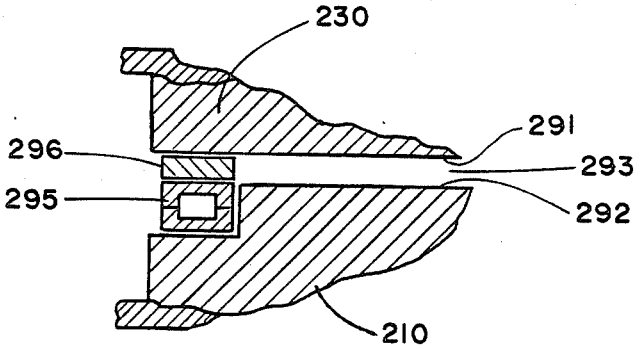
FIG. 9 is an enlarged, partial sectional view of one embodiment of two rollers forming one pressurized roller system taken along line 9—9 in FIG. 5 and showing the spacer bearings and a differential speed roller arrangement which provide the spaced apart relationship therebetween.

In FIG. 9 roller face 291 of roller 230 and roller face 292 roller 210 are positioned in a spaced apart relationship in region 293 along the longitudinal axis of each roller. The spaced apart relationship of the rollers is provided by idler bearings 295 which encircle each end of roller 210 and spacer ring 296 which encircles and is mounted to each idler bearing, or other such means. Machining of each end of the roller can be performed as required in order to provide the desired fit of idler bearing assembly and spacer ring. Roll contact is provided between the roller face of roller 230 and either a surface of the idler bearing assembly or the spacer ring encircling roller 210. The surface of the idler bearing assembly and encircling spacer ring extend longitudinally along a portion of that roller. Roller face 292 of roller 210 can be grooved, roughed, or smooth (as shown in FIG. 9). The spaced apart relationship of the rollers is a distance which approximates the thickness of sheet-like reclaimed tobacco material, and generally the distance ranges from about 0.003 inch to about 0.007 inch, with about 0.004 inch being preferred. Of particular interest is the fact that for this embodiment the drive gears (not shown) which turn rollers 210 and 230 can be arranged in order that there is a linear speed differential between the roller surfaces of each of rollers 210 and 230. The linear speed differential between rotating rollers 210 and 230 depends upon factors such as the character of the tobacco material being processed, the roller diameters, etc. Typically, linear speed differentials range from greater than 0 inches per minute, preferably greater than about 30 inches per minute, up to about 120 inches per minute, preferably up to about 60 inches per minute, for a pair of 4 inch diameter rollers. It is believed that an additional shearing action can be created between the rollers rotating at different linear speeds that is capable of aligning more of the individual tobacco fibers, thereby providing the capability of producing a homogeneous and strong sheet.

Figure 10:
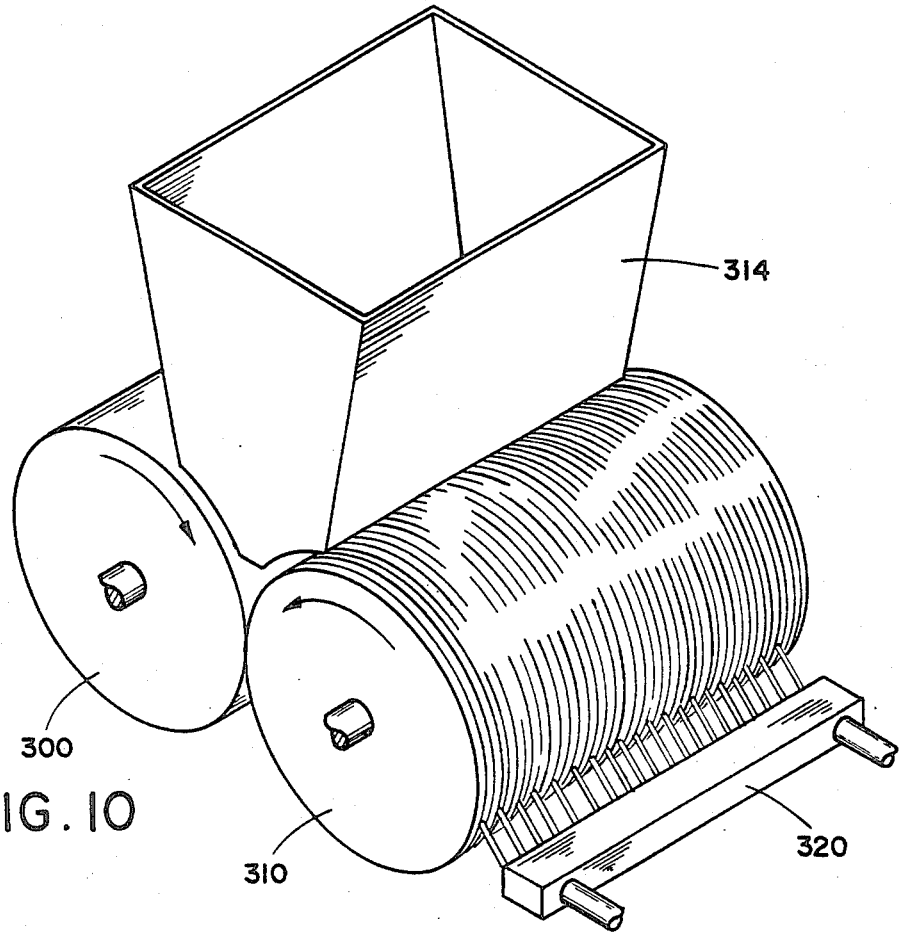
FIG. 10 is a perspective of an apparatus useful in the process of this invention.

In FIG. 10, an apparatus for conducting a portion of the process of this invention comprises a pressurized roller system including roller 500 having a substantially smooth surface and grooved roller 510 in roll contact therewith. The rollers are rotated such that tobacco material is fed from hopper 514 into the nip region of the rollers passes through the rollers in the form of compressed material such as a flaky sheet. Both of the rollers are supported on a frame (not shown) and are operated as described for the previous embodiments. Processed material can be removed from the grooved roller 510 as described hereinbefore using scrape 520 such as a comb-like means.

Figure 11:
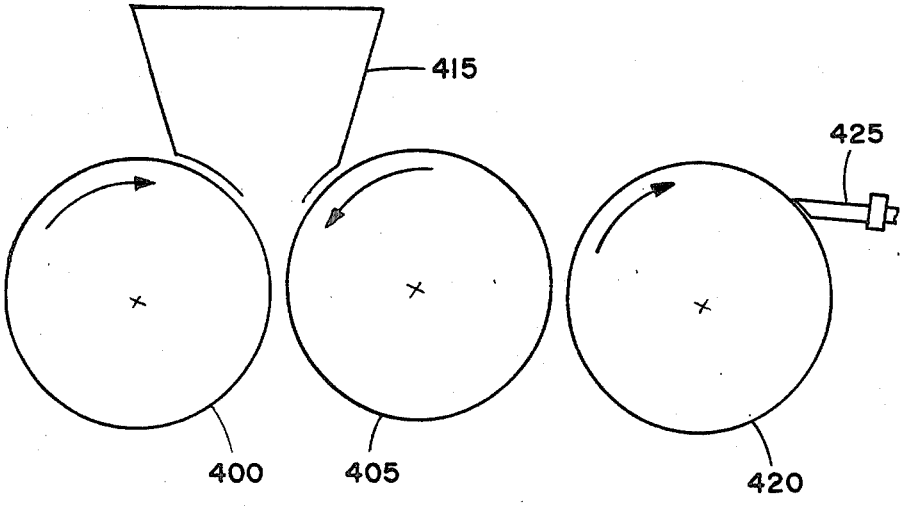
FIG. 11 is a diagrammatic illustration of one apparatus useful in a portion of the process of this invention showing three rollers which can provide sheet form tobacco material.

FIG. 11 illustrates an appartus for conducting a portion of the process of this invention. The apparatus comprises 3 rollers in horizontal alignment and not in roll contact. The 3 rollers typically have substantially smooth surfaces, and are constructed from materials as described hereinbefore. First roller 400 and second roller 405 are rotated in directions opposite to one another such that previously processed tobacco material fed in hopper 415 can pass through the nip thereof. Third roller 420 is rotated in a direction opposite to second roller 405 such that processed tobacco material passes through the nip thereof. Typically, first roller 400 is rotated at about 20 rpm to about 50 rpm; second roller 405 is rotated at a greater speed than the first roller; and third roller 420 is rotated at a greater speed than the second roller. The greater rotational speed of the second roller relative to the first roller provides the tendency for tobacco material to adhere to the second roller; and similarly the greater rotational speed of the third roller relative to the second roller provides the tendency for tobacco material to adhere to the third roller. Tobacco material in generally sheet-like form (e.g., as a sheet-like product) is removed from the surface of the third roller using scrape 425 which extends along the roller face thereof. The rollers are supported by a frame (not shown) and are rotated using a power source (not shown) and a series of drive gears (not shown).

The processed tobacco material which is provided according to the process of this invention can be provided generally in the form of a sheet. The sheet-like material exhibits good flexibility and tensile strength. Typically, the processed tobacco material in the form of a sheet exhibits a structural strength which approaches that of tobacco leaf. By the term "sheet" as used herein is meant that the tobacco material is in a form wherein the length and width thereof are substantially greater than the thickness thereof. Typically, the thickness of the sheet approximates that of tobacco leaf, cured or processed tobacco leaf, or wet reconstituted tobacco sheet product. For example, the thickness of the sheet can range from about 0.005 inch to about 0.040 inch, preferably from about 0.005 inch to about 0.015 inch. The length and width of the sheet or strip of processed tobacco material can vary. The width of the sheet generally is determined by factors such as the longitudinal distance which the rollers of the second pressurized roller system are in a spaced apart relationship, the length of the means for removing the processed tobacco material from the roller face of the rollers, and the like. The sheet-like material exhibits good flexibility and tensile strength. The sheet can be cut as are tobacco leaf or wet formed reconstituted tobacco material (e.g., in strips of about 32 cuts per inch) using various cutting devices. The processed tobacco material can be cased, top dressed and treated with numerous flavorants, and employed as cut filler in the manufacture of cigarettes.

The following examples are provided in order to further illustrate various embodiments of the invention but should not be construed as limiting the scope thereof. Unless otherwise noted, all parts and percentages are by weight.

EXAMPLE 1

Sheet form tobacco material is provided using the following procedure.

Into a Hobart-HMC-450 high shear mixer equipped with a stainless steel shaft and 2 stainless steel blades each having lengths of about 8 inches is placed 4 kg of a mixture of tobacco leaves. The tobacco blend is 2 parts flue cured total leaf, 1 part burley total leaf, and 1 part Maryland tobacco total leaf. Each of the tobaccos have been cured and aged.

The tobacco is chopped to sizes less than about 2 inches in maximum dimension by running the mixer at 3500 rpm for 5 minutes.

To the container is placed essentially dry form binding agent in the form of 0.9 percent locust bean gum and 0.9 percent xanthan gum, based on tobacco dry weight. The shredded tobacco and binding agent each have a moisture content of about 6 to about 12 percent. The mixer is jogged for about 15 seconds in order to mix (i.e., blend) the binding agent and chopped tobacco. The mixture of binding agent and tobacco is a flaky material resembling dry, chopped tobacco. The mixer is then run, and water is added to the container as mixing commences. Enough water is added to provide a mixture having a total moisture content of 18 percent. The mixture is mixed at high shear agitation (i.e., about 3500 rpm) for about 5 minutes. The material so processed is a damp collection of essentially soft, agglomerated particles each having a range of size less than about 1 inch in maximum dimension. The material exhibits a slightly tacky feel, and can be formed into a ball by hand. The resulting material which has been subjected to high shear agitation is processed further in order to provide sheet form tobacco material.

A roll apparatus which is generally described in FIGS. 5 and 6 is provided. Roller 330 is constructed from hardened steel, has a substantially smooth surface, and has a diameter of 4 inches and a roller face having a length of 4 inches. Roller 320 has a diameter of 4 inches and is of similar length and construction to roller 330; however, roller 320 contains grooves extending in a radial fashion about the periphery thereof. Roller 320 contains grooves in a 2 inch distance longitudinally along the roller face, and the 1 inch distance along the roller face at each end of the roller is relatively smooth. The grooved portion of the roller is generally described in FIG. 4. The depth d of the grooves is about 0.009 inch, the pitch p of each groove is about 0.03125 inch, and the angle A′ is about 90°. The top portion 82 of each groove is flattened by a distance of about 0.008 inch, and the bottom of each groove is flattened by a distance of about 0.003 inch. Roller 310 is equipped at each end thereof with an idler bearing assembly and spacer ring generally as described in FIG. 9. Each idler bearing assembly and circumscribing spacer ring provides a spaced apart relationship of 0.004 inch between the roller faces of rollers 310 and 330. Roller 310 is rotated at a linear speed of from 10 inches per minute to 30 inches per minute, and is rotated at about 1 to about 3 rpm faster than each of rollers 320 and 330, during the processing of the tobacco material. The previously described mixture of shear agitated tobacco material and binding agent is passed through the previously described roll apparatus. In particular, the tobacco material is passed through the nip of rollers 320 and 310, and then through the nip of rollers 330 and 310 of the roll apparatus. The resulting compressed material so processed generally resembles a flaky sheet-like material.

The resulting compressed, flaky sheet-like material is further processed to a processed tobacco material in the form of a continuous sheet using an apparatus generally described in FIG. 10.

The apparatus is a roll mill sold commercially as Kent Model 4″×8″ Lab, High-Speed, 3 Roll Mill by Chas. Ross & Son Co., Hauppauge, N.Y., USA. The apparatus comprises 3 rollers each having a substantially smooth roll face. The rollers each have a longitudinal length of 8 inches and a diameter of 4 inches. The rollers are positioned in a horizontal position with their roll faces parallel to one another. The spacing between the roll faces is adjusted to about 0.005 inch. The filler material is transferred to the hopper which feeds said material to the zone between the first 2 rollers. The first roller is rotated at a roll speed of 30 rpm. The second roller is rotated at a roll speed of 3 times that of the first roller (i.e., 90 rpm). The material passes between the rollers and then passes between the second and third rollers. The third roller is rotated at roll speed of 3 times the second roller (i.e., 270 rpm). The sheet form tobacco material product is collected from the third roller using a doctor blade positioned along the roll face of the third roller near the extreme vertical portion of the roller. The doctor blade is extended to provide a collection tray for the product. The tobacco material is a continuous sheet, about 8 inches in width and having a thickness between about 0.004 inch and about 0.03 inch.

EXAMPLE 2

Sheet form tobacco material is provided using the following procedure.

Into the Hobard-HMC-450 high shear mixer described in Example 1 is placed 4 kg of a mixture of tobacco leaves. The tobacco blend is 1 part flue cured total leaf, 2 parts burley total leaf and 1 part Turkish total leaf. Each of the tobaccos have been cured and aged.

The tobacco is chopped to sizes less than about 2 inches in maximum dimension by running the mixer at 1750 rpm for about 8 to about 10 minutes.

To the container is placed essentially dry form binding agent in the form of 0.9 percent xanthan gum and 0.9 percent guar gum, based on tobacco dry weight. The shredded tobacco and binding agent each have a moisture content of about 6 percent to about 8 percent. To the mixture is added 10 percent of an aqueous based tobacco extract, less than 1 percent glycerine, and 4 percent aqueous based top dressing (all percentages based on tobacco dry weight). The resulting mixture has a total moisture content of about 20 percent. The mixer is jogged for about 15 seconds in order to mix (i.e., blend) the binding agent and chopped tobacco. The mixer is then run. The mixture is mixed at high shear agitation (i.e., about 3500 rpm) for about 5 minutes. The material so processed resembles the soft, damp, agglomerated material described in Example 1. The resulting material which has been subjected to high shear agitation is processed further in order to provide sheet form tobacco material.

An apparatus which is generally described in FIGS. 2, 3 and 4 is provided. Roller 130 is constructed of hardened carbon steel, has a substantially smooth surface, and has a diameter of 5 inches and a roller face having a length of 8 inches. Roller 120 has a diameter of 5 inches and is of similar length and construction to roller 130. Roller 110 comprises grooves in a 5 inch distance longitudinally along the roller face, and the 1.5 inch distance along the roller face at each end of the roller is relatively smooth. The grooved portion of roller 110 is generally described in FIG. 4. The depth d of the grooves is about 0.0155 inch, the pitch p of each groove is about 0.031 inch, and the angle A′ is about 60°. The top portion of each groove is flattened by a distance of about 0.01275 inch, and the bottom of each groove is flattened by a distance of about 0.006 inch. The rollers are operated using variable speed drive using a variable speed 1.5 horsepower electric motor at a speed of about 4 rpm, and a nip zone pressure of about 5000 pounds per linear inch is generated. The angle A provided by the central axis of roller 120, roller 110 and roller 130, respectively, is 90°. Scrape 156 in the form of a blade is positioned so as to remove the reclaimed tobacco material from roller 110. Force is provided to each of rollers 110, 120 and 130 by two compression rollers positioned in roll contact with each of rollers 110, 120, and 130. Each compression roller is positioned at one end of each of rollers 110, 120 and 130. The compression rollers are about 1 inch in longitudinal length and about 2 inches in diameter. Force is provided to the compression rollers by jack screws.

The roll apparatus which is generally described in FIGS. 5 and 6, and described in detail in Example 1 is provided. The previously described compressed material is passed through the roll apparatus in order to provide a continuous sheet of processed tobacco material. The roll apparatus is employed substantially as described in Example 1. The width of sheet so provided is about 5 inches and the thickness is about 0.018 inch.

EXAMPLE 3

Sheet form tobacco material is provided using the following procedure.

Into the Hobard-HMC-450 high shear mixer described in Example 1 is placed 3 kg of a mixture of tobacco leaves. The tobacco blend is 1 part flue cured total leaf, 1 part burley total leaf and 1 part Turkish whole leaf. Each of the tobaccos have been cured and aged.

The tobacco is chopped to sizes less than about 2 inches in maximum dimension by running the mixer at 3500 rpm for 5 minutes.

To the container is placed essentially dry form binding agent in the form of 1 percent xanthan gum and 1 percent guar gum, based on tobacco dry weight. The shredded tobacco and binding agent each have a moisture content of about 8 percent. To the mixture is added 0.9 percent casing mixture and 4 percent aqueous based top dressing (both percentages based on tobacco dry weight). The mixer is jogged for about 30 seconds in order to mix (i.e., blend) the binding agent and chopped tobacco. The mixer is then run and water is added to the container as mixing commences. Enough water is added to provide a mixture having a total moisture content of 20 percent. The mixture is mixed at high shear agitation (i.e., about 1750 rpm) for about 5 minutes. The material so processed resembles the soft, damp agglomerated material described in Example 1. The resulting material which has been subjected to high shear agitation is processed further in order to provide sheet form tobacco material.

The roll apparatus which is generally described in FIGS. 5 and 6, and described in detail in Example 1 is provided. The previously described mixture of sheet agitated tobacco material and binding agent is passed through the roll apparatus as described in Example 1. The resulting compressed material so processed generally resembles wet rolled tobacco stems. This compressed material is processed further to provide sheet form tobacco material. In particular, the compressed material is passed through the roll apparatus a second time in order to provide a continuous sheet of processed tobacco material. The roll apparatus is employed substantially as described in Example 1. The width of the resulting sheet is about 4 inches and the thickness is 0.018 inch.

EXAMPLE 4

Sheet form tobacco material is provided using the following procedure.

Into the Hobard-HMC-450 high shear mixer described in Example 1 is placed 3 kg of a mixture of tobacco leaves. The tobacco blend is 1 part flue cured total leaf, 1 part burley total leaf, and 1 part tobacco dust. Each of the tobaccos in total leaf form have been cured and aged.

The tobacco is chopped to sizes less than 2 inches in maximum dimension by running the mixture at 3500 rpm for 5 minutes.

To the container is placed essentially dry form binding agent in the form of 6 percent sodium carboxymethylcellulose and 2.7 percent guar gum. The shredded tobacco and binding agent each have a moisture content of about 8 percent and 6 percent, respectively. To the mixture is added 0.9 percent casing mixture and 2 percent aqueous based top dressing (both percentages based on tobacco dry weight). The mixer is jogged for about 15 seconds in order to mix (i.e., blend) the binding agent and chopped tobacco. The mixer is the run and water is added to the container as mixing commences. Enough water is added to provide a mixture having a total moisture content of 18 percent. The mixture is mixed at high shear agitation (i.e., about 1750 rpm) for about 5 minutes. The material so processed resembles the soft, damp, agglomerated material described in Example 1. The resulting material which has been subjected to high shear agitation is processed further in order to provide sheet form tobacco material.

The roll apparatus which is generally described in FIGS. 5 and 6, and described in detail in Example 1 is provided. The previously described mixture of sheet agitated tobacco material and binding agent is passed through the roll apparatus as described in Example 1. The resulting compressed material so processed generally resembles damp rolled tobacco stems. This compressed material is processed further to provide sheet form tobacco material.

The compressed material is transferred to a vibrating hopper which feeds a single screw extruder. The single screw extruder comprises a constant pitch metal screw 16 inches long. The diameter of the screw is 1.5 inch and flights are positioned along the length of the screw at a 2 inch pitch. The single screw extruder feeds into a pressurized roller system. The extruder and roller system is a commercially available TS-10 Roll Press supplied by Material Processing Corporation, Amherst, Ill., USA. The compressed tobacco material/binding agent mixture is passed through the screw extruder which is run at about 30 rpm using a 1.5 hp motor. the temperature within the barrel is stabilized at about 85° F. The mixture is passed from the extruder through a metal die having a rectangular die opening of 0.25 inch by 1.5 inch. The filler material and binding agent mixture which has been subjected to high shear is fed from the die directly through the nip of two rollers which are in roll contact and form a pressured roller system. The rollers each are generally cylindrical and have a 6 inch diameter and a longitudinal length of 6 inches. The two rollers are held in roll contact using jack screws, and a separating force of 30,000 pound is generated between the rollers. The force between the rollers is lowered in an amount to provide sheet production. Both of the rollers have a substantially smooth roll face. The rollers are operated at a roll speed of from about 10 to about 72 rpm.

Tobacco material in sheet form is provided from the material which passes through the rollers. Sheets are provided by scraping the tobacco material from the roller using a doctor blade which extends along the width of the roller face. The continuous sheet is 6 inches wide, 0.02 inch thick, and has the general appearance of tobacco laminae.

EXAMPLE 5

Sheet form tobacco material is provided using the following procedure.

Into the Hobard-HMC-450 high shear mixer described in Example 1 is placed 5 kg of a mixture of tobacco leaves. The tobacco blend is 2 parts flue cured total leaf, 2 parts burley total leaf, and 1 part Turkish tobacco scrap. Each of the tobaccos have been cured and aged.

The tobacco is chopped to sizes, less than about 2 inches in maximum dimension by running the mixer at 1750 rpm for 8 minutes.

To the container is placed essentially dry form binding agent in the form of 1 percent sodium carboxymethylcellulose and 1 percent locust bean gum (both percentages based on tobacco dry weight). The shredded tobacco and binding agent each have a moisture content of about 10 percent. The mixer is jogged for about 30 seconds in order to mix (i.e., blend) the binding agent and chopped tobacco. The mixer is then run and water is added to the container as mixing commences. Enough water is added to provide a mixture having a total moisture content of 16 percent. The mixture is mixed at high shear agitation (i.e., about 3700 rpm) for about 5 minutes. The material so processed resembles the soft, damp, agglomerated material described in Example 1. The resulting material which has been subjected to high shear agitation is processed further in order to provide sheet form tobacco material.

The roll apparatus which is generally described in FIGS. 5 and 6, and described in detail in Example 1 is provided. The previously described mixture of agitated tobacco material and binding agent is passed through the roll apparatus as described in Example 1. The resulting compressed material so processed generally resembles damp rolled tobacco stems. This compressed material is processed further to provide sheet form tobacco material. In particular, the compressed material is passed through the roll apparatus generally described in FIG. 10.

A roll apparatus which is generlly described in FIG. 10 is provided. Roller 300 is constructed from hardened steel, has a smooth surface, and has a diameter of 6 inches and a roller face having a length of 4 inches. Roller 310 has a diameter of 6 inches and is of similar length and construction to roller 300; however, roller 310 contains grooves extending in a radial fashion about the periphery thereof. Roller 310 contains grooves in a 4 inch distance longitudinally along the roller face. The grooved portion of the roller is generally described in FIG. 4. The depth d of the grooves is about 0.009 inch, the pitch p of each groove is about 0.03125 inch, and the angle A′ is about 60°. The top portion of each groove is flattened by a distance of about 0.008 inch, and the bottom of each groove is flattened by a distance of about 0.003 inch. The rollers both are rotated at about 35 rpm. The power source is a 1.5 horsepower motor having a geared drive system. Jack screws provide a pressure between the rollers of about 1,000 pounds per linear inch. The previously described mixture of processed tobacco material is passed through the previously described roll apparatus. In particular, the tobacco material is passed through the nip of rollers 300 and 310, of the roll apparatus. The resulting material so processed generally resembles corrugated sheet of reconstituted tobacco.

The processed material is passed through the roller apparatus described in detail in Example 1 and shown in FIG. 11. The resulting material is a continuous sheet resembling the laminae portion of a tobacco leaf.

EXAMPLE 6

Tobacco material is processed as described in Example 5. However, the sheet-like product is provided using the extrusion apparatus and roller configuration described in Example 4, rather than using the roller apparatus shown in FIG. 11. The extrusion apparatus and roller configuraion is employed as described in Example 4.

EXAMPLE 7

Tobacco material as described in Example 4 is processed in the manner described in Example 4 to yield the soft, damp, agglomerated material. The material is twice passed through the roll apparatus described in Example 5 and shown in FIG. 10, in the manner described in Example 5. The material is then passed twice through the roll apparatus described in Example 1 and shown in FIG. 11, in the manner described in Example 1.

What is claimed is:

1. A process for providing processed material in sheet-like form, the process comprising:

(a) providing tobacco material wherein at least substantial proportion thereof is provided in essentially whole leaf form; and (b) providing in essentially dry, substantially non-binding form, binding agent which is capable of being activated; and (c) subjecting the aforementioned tobacco material to a size reduction action in order to provide divided tobacco material; and then (d) contacting the divided tobacco material and binding agent; and then (e) subjecting the divided tobacco material and binding agent to high shear agitation (i) in the presence of sufficient moisture to provide for activation of the binding agent but in the presence of a moisture content of less than 30 percent based on the total weight of moisture, binding agent and tobacco material, and (ii) for a period of time sufficient to at least initiate activation of the binding agent; and then (f) subjecting the tobacco material so subjected to high shear agitation to compressive treatment by passing the tobacco material, at least once, through the nip of a roller system; and then (g) forming sheet-like processed tobacco material from the tobacco material which has been passed through the aforementioned roller system.

2. The process of claim 1 wherein said roller system is a pressurized roller system.

3. The process of claim 2 wherein said pressurized roller system includes two rollers exhibiting a nip zone pressure sufficient to provide compression of the tobacco material, wherein (i) at least one of the roller faces comprises a series of grooves, the series extending longitudinally along the roller and each groove extending about the periphery of the roller, and (ii) each groove has a maximum width near the surface of the roller and a minimum width near the bottom of the groove.

4. The process of claim 3 wherein each of said grooves is generally "V" shaped.

5. The process of claim 3 wherein each groove circumscribes the roller substantially transversely relative to the longitudinal axis of the roller.

6. The process of claim 2 wherein the nip zone pressure ranges from about 1,000 pounds per linear inch to about 10,000 pounds per linear inch.

7. The process of claim 1 wherein essentially all of the tobacco material is in essentially whole leaf form.

8. The process of claim 7 wherein a blend of tobacco types is employed.

9. The process of claim 1 wherein said size reduction action is a cutting action.

10. The process of claim 9 wherein said cutting action is provided by a high shear shredding device.

11. The process of claim 1 wherein said tobacco material and binding agent are subjected to high shear agitation in the presence of a moisture content between about 12 percent and about 25 percent, based on the total weight of moisture, binding agent and tobacco material.

12. The process of claim 1 wherein said tobacco material and binding agent are subjected to high shear agitation in the presence of a moisture content between about 15 percent and about 18 percent, based on the total weight of moisture, binding agent and tobacco material.

13. The process of claim 1 wherein the amount of binding agent is less than about 15 weight percent, based on the total weight of binding agent, moisture and tobacco material dry weight.

14. The process of claim 1 wherein the amount of binding agent is less than about 10 weight percent, based on the total weight of binding agent, moisture and tobacco material dry weight.

15. The process of claim 1 wherein the amount of binding agent is less than about 2 weight percent, based on the total weight of binding agent, moisture and tobacco material dry weight.

16. The process of claim 1 wherein said binding agent is capable of being moisture activated.

17. The process of claim 1 wherein said high shear agitation is provided for a period of about 5 minutes to about 1 kg to about 10 kg of tobacco material, binding agent and moisture by a Hobart HMC-450 Mixer providing an agitation rate of greater than about 1,000 rpm.

18. The process of claim 7 wherein the size reduction action provides portions of stems wherein the majority thereof exhibits a length in the range from about 0.25 inch to about 1 inch.

19. The process of claim 1 wherein flavorant is incorporated into the divided material so subjected to high shear agitation prior to the forming of the sheet-like processed tobacco material.

20. The process of claim 1 wherein the forming of the sheet-like processed tobacco material is performed using a roller system.

21. A process for providing processed tobacco in sheet-like form, the process comprising:

(a) providing tobacco material wherein at least a substantial proportion thereof is provided in essentially whole leaf form; and (b) providing in essentially dry, substantially non-binding form, binding agent which is capable of being activated; and (c) contacting the tobacco material and binding agent; and then (d) subjecting the tobacco material and binding agent to high shear agitation (i) including a cutting action in an amount sufficient to provide divided tobacco material, (ii) in the presence of sufficient moisture to provide for activation of the binding agent but in the presence of a moisture content of less than 30 percent based on the total weight of the moisture, binding agent and tobacco material, and (iii) for a period of time sufficient to at least inititate activation of the binding agent; and then (e) subjecting the tobacco material so subjected to high shear agitation to compressive treatment by passing the tobacco material, at least once, through the nip of a roller system; and then (f) forming sheet-like processed tobacco material from the tobacco material which has been passed through the aforementioned roller system.

22. The process of claim 21 wherein said roller system is a pressurized roller system.

23. The process of claim 22 wherein said pressurized roller system includes two rollers exhibiting a nip zone pressure sufficient to provide compression of the tobacco material, wherein (i) at least one of the roller faces comprises a series of grooves, the series extending longitudinally along the roller and each groove extending about the periphery of the roller, and (ii) each groove has a maximum width near the surface of the roller and a minimum width near the bottom of the groove.

24. The process of claim 23 wherein each of said grooves is generally "V" shaped.

25. The process of claim 23 wherein each groove circumscribes the roller substantially transversely relative to the longitudinal axis of the roller.

26. The process of claim 22 wherein the nip zone pressure ranges from about 1,000 pounds per linear inch to about 10,000 pounds per linear inch.

27. The process of claim 21 wherein essentially all of the tobacco material is in essentially whole leaf form.

28. The process of claim 27 wherein a blend of tobacco types is employed.

29. The process of claim 21 wherein said size reduction action is a cutting action.

30. The process of claim 29 wherein said cutting action is provided by a high shear shredding device.

31. The process of claim 21 wherein said tobacco material and binding agent are subjected to high shear agitation in the presence of a moisture content between about 12 percent and about 25 percent, based on the total weight of moisture, binding agent and tobacco material.

32. The process of claim 21 wherein said tobacco material and binding agent are subjected to high shear agitation in the presence of a moisture content between about 15 percent and about 18 percent, based on the total weight of moisture, binding agent and tobacco material.

33. The process of claim 21 wherein the amount of binding agent is less than about 15 weight percent, based on the total weight of binding agent, moisture and tobacco material dry weight.

34. The process of claim 21 wherein the amount of binding agent is less than about 10 weight percent, based on the total weight of binding agent, moisture and tobacco material dry weight.

35. The process of claim 21 wherein the amount of binding agent is less than about 2 weight percent, based on the total weight of binding agent, moisture and tobacco material dry weight.

36. The process of claim 21 wherein said binding agent is capable of being moisture activated.

37. The process of claim 21 wherein said high shear agitation is provided for a period of about 5 minutes to about 1 kg to about 10 kg of tobacco material, binding agent and moisture by a Hobart HMC-450 Mixer providing an agitation rate of greater than about 1,000 rpm.

38. The process of claim 27 wherein the size reduction action provides portions of stems wherein the majority thereof exhibits a length in the range from about 0.25 inch to about 1 inch.

39. The process of claim 21 wherein flavorant is incorporated into the divided material so subjected to high shear agitation prior to the forming of the sheet-like processed tobacco material.

40. The process of claim 21 wherein the forming of the sheet-like processed tobacco material is performed using a roller system.

* * * * *